US008836584B2

(12) United States Patent
Kim et al.

(10) Patent No.: US 8,836,584 B2
(45) Date of Patent: Sep. 16, 2014

(54) MOBILE TERMINAL

(75) Inventors: Changil Kim, Gyeonggi-Do (KR); Seungwoo Ryu, Gyeonggi-Do (KR); Yeomin Youn, Gyeonggi-Do (KR); Soyeon Lee, Gyeonggi-Do (KR); Kyunghack Yi, Seoul (KR); Chisang You, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 364 days.

(21) Appl. No.: 13/220,050

(22) Filed: Aug. 29, 2011

(65) Prior Publication Data

US 2012/0235866 A1 Sep. 20, 2012

(30) Foreign Application Priority Data

Mar. 16, 2011 (KR) ..... 10-2011-0023561

(51) Int. Cl.

| | |
|---|---|
| ***H01Q 1/38*** | (2006.01) |
| ***H01Q 7/00*** | (2006.01) |
| ***H01Q 1/24*** | (2006.01) |
| ***H01Q 5/00*** | (2006.01) |
| ***H01Q 9/42*** | (2006.01) |

(52) U.S. Cl.

CPC ..... *H01Q 1/243* (2013.01); *H01Q 7/00* (2013.01); *H01Q 5/0062* (2013.01); *H01Q 9/42* (2013.01)

USPC ..... 343/700 MS; 343/702

(58) Field of Classification Search

None

See application file for complete search history.

(56) References Cited

U.S. PATENT DOCUMENTS

| | | | | |
|---|---|---|---|---|
| 2005/0153756 | A1* | 7/2005 | Sato et al. | 455/575.7 |
| 2007/0285321 | A1 | 12/2007 | Chung et al. | |
| 2008/0180333 | A1* | 7/2008 | Martiskainen et al. | 343/722 |
| 2011/0001673 | A1* | 1/2011 | You et al. | 343/702 |
| 2012/0154222 | A1* | 6/2012 | Oh et al. | 343/702 |

FOREIGN PATENT DOCUMENTS

| | | | |
|---|---|---|---|
| CN | 101953022 | B | 10/2013 |
| EP | 1 555 715 | A1 | 7/2005 |
| WO | WO 2008/059509 | A2 | 5/2008 |

* cited by examiner

*Primary Examiner* — Trinh Dinh

(74) *Attorney, Agent, or Firm* — Birch, Stewart, Kolasch & Birch, LLP

(57) ABSTRACT

A mobile terminal includes a main body having a ground, a first conductor installed in the main body and connected with the ground so as to be power-fed, and a second conductor facing the first conductor in order to be configured to transmit and receive radio signals of a plurality of mutually adjacent frequency bands to and from the first conductor. The second conductor includes a first portion spaced apart by a pre-set distance from the first conductor so as to be coupled with the first conductor, and second portions extending from the first portion in both directions and coupled at a plurality of locations with the ground in order to form a plurality of conductive loops extending from the ground, the first conductor, and the second.

15 Claims, 10 Drawing Sheets

MOBILE TERMINAL

CROSS REFERENCE TO RELATED APPLICATIONS

The present application claims priority to Korean Application No. 10-2011-0023561 filed in Korea on Mar. 16, 2011, the entire contents of which is hereby incorporated by reference in its entirety.

BACKGROUND OF THE INVENTION

1. Field of the Invention

The present invention relates to a mobile terminal having an antenna unit transmitting and receiving radio signals.

2. Description of the Related Art

In general, terminals may be divided into a mobile terminal and stationary terminal according to whether or not terminals are movable. In addition, mobile terminals may be divided into a handheld terminal and a vehicle mount terminal according to whether or not users can carry the terminal.

As such functions become more diversified, terminals can support more complicated functions such as capturing images or video, reproducing music or video files, playing games, receiving broadcast signals, and the like. By comprehensively and collectively implementing such functions, terminals may be embodied in the form of a multimedia player or device.

In order to implement various functions of such multimedia players or devices, numerous attempts are being made and implemented in terms of hardware or software. For example, a user interface allowing users to easily and conveniently search for and select one or more functions is provided.

In addition, as users consider their mobile terminals as personal belongings to express their personality, mobile terminals are expected to have various designs. The designs may include a structural change and enhancement allowing users to conveniently use mobile terminals. An antenna device may be considered as one of such structural changes and enhancements.

SUMMARY OF THE INVENTION

An aspect of the present invention provides a mobile terminal having an antenna unit having improved performance.

Another aspect of the present invention provides an antenna unit for transmitting and receiving multi-radio signal of a low frequency band in a small space, and a mobile terminal having the same.

According to an aspect of the present invention, a mobile terminal includes a terminal main body having a ground, a first conductor installed in the terminal main body and connected with the ground so as to be power-fed, and a second conductor configured to face the first conductor in order to transmit and receive radio signals of a plurality of mutually adjacent frequency bands to and from the first conductor. The second conductor includes a first portion spaced apart by a pre-set distance from the first conductor so as to be coupled with the first conductor and second portions extending from the first portion and coupled at a plurality of locations with the ground to generate a plurality of conductive loops starting from the ground and continuing to the first conductor, the second conductor, and the ground.

In an embodiment of the present invention, the first conductor may include a conductive body and a power feed arm. The conductive body is formed to be parallel to the first portion so as to be coupled with the second conductor. The power feed arm may extend from the conductive body and be connected with the ground so as to be power-fed.

A carrier may be mounted to be adjacent to one end of the main body and the conductive body may be disposed on one surface of the carrier. The second conductor may be mounted on one surface of the carrier. The second conductor may be formed to face the case of the main body. The second conductor may be formed to cover the entirety of the conductive body in at least one direction.

In another embodiment of the present invention, the second portions may extend in the mutually opposite directions based on the first portion, and include first and second edge portions formed at edges of the second conductor.

The plurality of conductive loops include first and second conductive loops, and the first and second conductive loops share the first conductor and branch off from the first portion to the first and second edge portions. End portions of the first and second edge portions may be separated from positions adjacent to the ground so as to be coupled with the ground. The first and second edge portions may be formed to transmit and receive radio signals of a plurality of mutually adjacent frequency bands. At least one of the first and second edge portions may be bent in a direction perpendicular to a direction extending from the first portion.

In another embodiment of the present invention, the second conductor may be exposed from the side portion of the main body to constitute the frame of the main body. The second conductor may be disposed at a side portion of the lower end of the main body and extend from both sides perpendicular to the side portion of the lower end of the main body. A metal member may be mounted on at least one of the both sides of the main body such that it is separated from the end portion of the second conductor.

In another embodiment of the present invention, the first conductor may be adjacent to one surface of the case forming an external appearance of the main body, and the second conductor may be patterned to be formed on one surface of the case or insertedly mounted in the case.

In another embodiment of the present invention, the ground is a metal plate member connected with a circuit board which processes the radio signals, a recess formed toward the circuit board may be formed at one end of the metal plate member, the first conductor may be accommodated in the recess, and the second conductor may be disposed in an opening of the recess.

In another embodiment of the present invention, the main body may include a front portion, a rear portion, and a side portion, and the second conductor may be bent between at least one of the front portion and the rear portion, and the side portion such that it is parallel to the at least one of the front portion and the rear portion, and the side portion.

In another embodiment of the present invention, a transmission frequency of the radio signal may include a frequency corresponding to LTE (Long Term Evolution).

According to another aspect of the present invention, a mobile terminal includes: a circuit board mounted in a terminal main body and configured to process a radio signal; a metal member having first and second bodies which are perpendicular to each other, an end portion of the second body being disposed to be adjacent to a ground of the circuit board, and forming an external appearance of the main body; and a coupler installed in the main body, connected with the circuit board so as to be power-fed by the circuit board, and coupled with the first body in a state of being separated by a pre-set distance in order to allow the metal member to transmit and receive the radio signal.

In another embodiment of the present invention, a current path may be formed starting from the ground of the circuit board to the coupler, and to the metal member through the coupling, and at least a portion of the ground may be disposed to be adjacent to an end portion of the second body to allow the current path to be continued to the ground. In order to form a plurality of current paths, the metal member may extend to both sides based on a portion facing the coupler.

In another embodiment of the present invention, a user input unit having at least a portion made of a conductive material may be formed on the side of the main body, and a gap may be formed between the end portion of the second body and the user input unit in order to separate the metal member and the user input unit.

Further scope of applicability of the present invention will become apparent from the detailed description given hereinafter. However, it should be understood that the detailed description and specific examples, while indicating preferred embodiments of the invention, are given by illustration only, because various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

The mobile terminal according to embodiments of the present invention will now be described with reference to the accompanying drawings. In the following description, usage of suffixes such as 'module', 'part' or 'unit' used for referring to elements is given merely to facilitate explanation of the present invention, without having any significant meaning by itself.

The mobile terminal described in the present invention may include mobile phones, smart phones, notebook computers, digital broadcast receivers, PDAs (Personal Digital Assistants), PMPs (Portable Multimedia Player), navigation devices, and the like.

Figure 1:
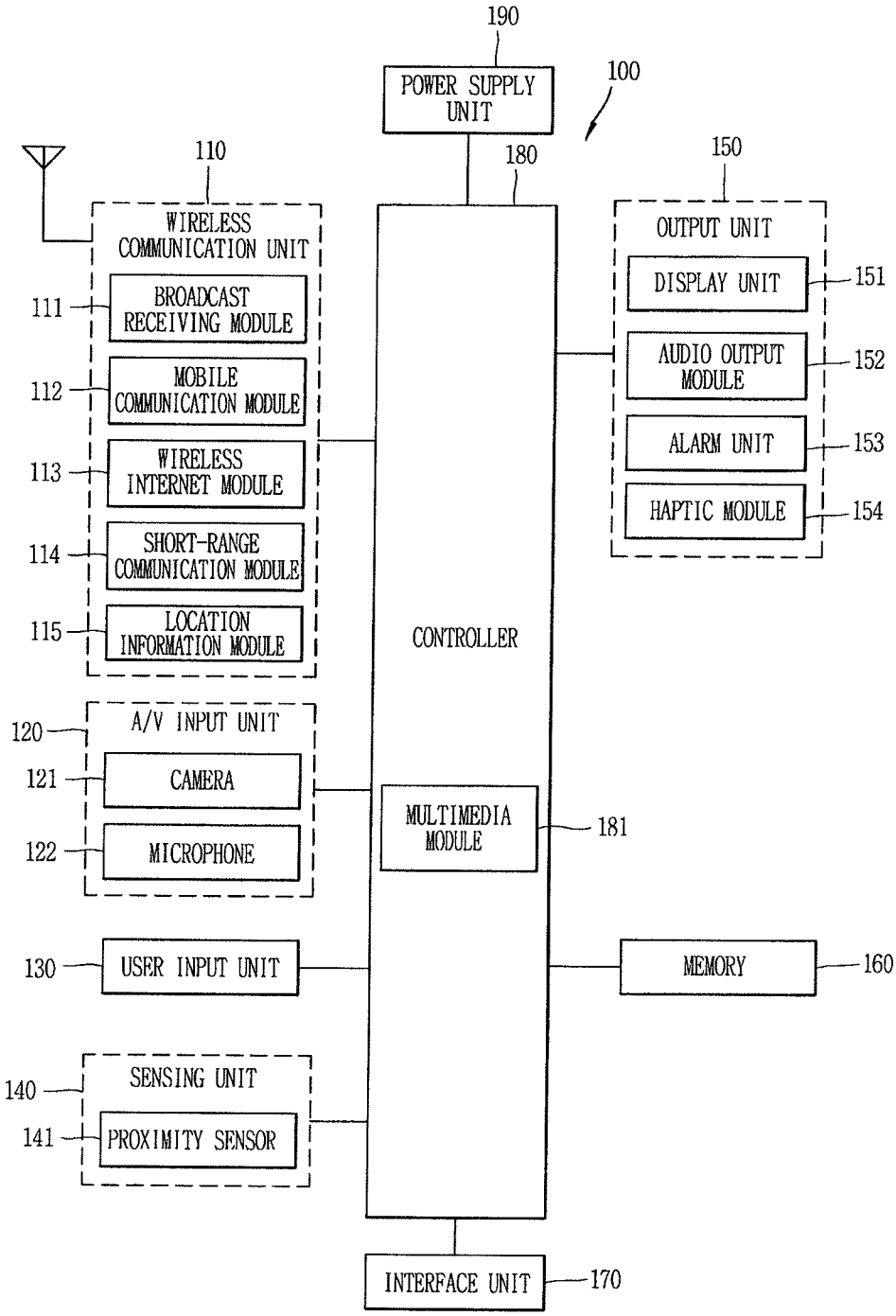
FIG. 1 is a schematic block diagram of a mobile terminal according to an embodiment of the present invention.

FIG. 1 is a block diagram of a mobile terminal according to an embodiment of the present invention.

The mobile terminal 100 may include a wireless communication unit 110, an A/V (Audio/Video) input unit 120, a user input unit 130, a sensing unit 140, an output unit 150, a memory 160, an interface unit 170, a controller 180, and a power supply unit 190, etc. FIG. 1 shows the mobile terminal as having various components, but it should be understood that implementing all of the illustrated components is not a requirement. Greater or fewer components may alternatively be implemented.

The elements of the mobile terminal will be described in detail as follows.

The wireless communication unit 110 typically includes one or more components allowing radio communication between the mobile terminal 100 and a wireless communication system or a network in which the mobile terminal is located. For example, the wireless communication unit may include at least one of a broadcast receiving module 111, a mobile communication module 112, a wireless Internet module 113, a short-range communication module 114, and a location information module 115.

The broadcast receiving module 111 receives broadcast signals and/or broadcast associated information from an external broadcast management server (or other network entity) via a broadcast channel.

The broadcast channel may include a satellite channel and/or a terrestrial channel. The broadcast management server may be a server that generates and transmits a broadcast signal and/or broadcast associated information or a server that receives a previously generated broadcast signal and/or broadcast associated information and transmits the same to a terminal. The broadcast signal may include a TV broadcast signal, a radio broadcast signal, a data broadcast signal, and the like. Also, the broadcast signal may further include a broadcast signal combined with a TV or radio broadcast signal.

The broadcast associated information may refer to information associated with a broadcast channel, a broadcast program or a broadcast service provider. The broadcast associated information may also be provided via a mobile communication network and, in this instance, the broadcast associated information may be received by the mobile communication module 112.

The broadcast associated information may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may be configured to receive signals broadcast by using various types of broadcast systems. In particular, the broadcast receiving module 111 may receive a digital broadcast by using a digital broadcast system such as multimedia broadcasting-terrestrial (DMB-T), digital multimedia broadcasting-satellite (DMB-S), digital video broadcast-handheld (DVB-H), the data broadcasting system known as media forward link only (MediaFLO®), integrated services digital broadcast-terrestrial (ISDB-T), etc. The broadcast receiving module 111 may be configured to be suitable for every broadcast system that provides a broadcast signal as well as the above-mentioned digital broadcast systems. Broadcast signals and/or broadcast-associated information received via the broadcast receiving module 111 may be stored in the memory 160 (or anther type of storage medium).

The mobile communication module 112 transmits and/or receives radio signals to and/or from at least one of a base station (e.g., access point, Node B, etc.), an external terminal (e.g., other user devices) and a server (or other network entities). Such radio signals may include a voice call signal, a video call signal or various types of data according to text and/or multimedia message transmission and/or reception.

The wireless Internet module 113 supports wireless Internet access for the mobile terminal. This module may be internally or externally coupled to the terminal. The wireless Internet access technique implemented may include a WLAN (Wireless LAN) (Wi-Fi), Wibro (Wireless broadband), Wimax (World Interoperability for Microwave Access), HSDPA (High Speed Downlink Packet Access), or the like.

The short-range communication module 114 is a module for supporting short range communications. Some examples of short-range communication technology include Bluetooth™, Radio Frequency IDentification (RFID), Infrared Data Association (IrDA), Ultra-WideBand (UWB), ZigBee™, and the like. The location information module 115 is a module for checking or acquiring a location (or position) of the mobile terminal. A typical example of the location information module is a GPS (Global Positioning System).

With reference to FIG. 1, the A/V input unit 120 is configured to receive an audio or video signal. The A/V input unit 120 may include a camera 121 (or other image capture device) and a microphone 122 (or other sound pick-up device). The camera 121 processes image data of still pictures or video obtained by an image capture device in a video capturing mode or an image capturing mode. The processed image frames may be displayed on a display unit 151 (or other visual output device). The image frames processed by the camera 121 may be stored in the memory 160 (or other storage medium) or transmitted via the wireless communication unit 110. Two or more cameras 121 may be provided according to the configuration of the mobile terminal.

The microphone 122 may receive sounds (audible data) via a microphone (or the like) in a phone call mode, a recording mode, a voice recognition mode, and the like, and can process such sounds into audio data. The processed audio (voice) data may be converted for output into a format transmittable to a mobile communication base station (or other network entity) via the mobile communication module 112 when in the phone call mode. The microphone 122 may implement various types of noise canceling (or suppression) algorithms to cancel (or suppress) noise or interference generated in the course of receiving and transmitting audio signals.

The user input unit 130 (or other user input device) may generate input data from commands entered by a user to control various operations of the mobile terminal. The user input unit 130 may include a keypad, a dome switch, a touch pad (e.g., a touch sensitive member that detects changes in resistance, pressure, capacitance, etc. due to being contacted) a jog wheel, a jog switch, and the like.

The sensing unit 140 (or other detection mechanism) detects a current status (or state) of the mobile terminal 100 such as an opened or closed state of the mobile terminal 100, a location of the mobile terminal 100, the presence or absence of user contact with the mobile terminal 100 (i.e., touch inputs), the orientation of the mobile terminal 100, an acceleration or deceleration movement and direction of the mobile terminal 100, etc., and generates commands or signals for controlling the operation of the mobile terminal 100. For example, when the mobile terminal 100 is implemented as a slide type mobile phone, the sensing unit 140 may sense whether the slide phone is opened or closed. In addition, the sensing unit 140 can detect whether or not the power supply unit 190 supplies power or whether or not the interface unit 170 is coupled with an external device. The sensing unit 140 may include a proximity sensor 141.

The output unit 150 is configured to provide outputs in a visual, audible, and/or tactile manner (e.g., audio signal, video signal, alarm signal, vibration signal, etc.). The output unit 150 may include the display unit 151, an audio output module 152, an alarm unit 153, a haptic module 154, and the like.

The display unit 151 may display (output) information processed in the mobile terminal 100. For example, when the mobile terminal 100 is in a phone call mode, the display unit 151 may display a User Interface (UI) or a Graphic User Interface (GUI) associated with a call or other communication (such as text messaging, multimedia file downloading, etc.). When the mobile terminal 100 is in a video call mode or image capturing mode, the display unit 151 may display a captured image and/or received image, a UI or GUI that shows videos or images and functions related thereto, and the like.

The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like. Some of the displays may be configured to be transparent or light-transmissive to allow viewing of the exterior, which may be called transparent displays. A typical transparent display may be, for example, a TOLED (Transparent Organic Light Emitting Diode) display, or the like. Through such configuration, the user can view an object positioned at the rear side of the terminal body through the region occupied by the display unit 151 of the terminal body.

The mobile terminal 100 may include two or more display units (or other display means) according to its particular desired embodiment. For example, a plurality of display units may be separately or integrally disposed on one surface of the mobile terminal, or may be separately disposed on mutually different surfaces.

Meanwhile, when the display unit 151 and a sensor (referred to as a 'touch sensor', hereinafter) for detecting a touch operation are overlaid in a layered manner to form a touch screen, the display unit 151 may function as both an input device and an output device. The touch sensor may have a form of a touch film, a touch sheet, a touch pad, and the like.

The touch sensor may be configured to convert pressure applied to a particular portion of the display unit 151 or a change in the capacitance or the like generated at a particular portion of the display unit 151 into an electrical input signal. The touch sensor may be configured to detect the pressure when a touch is applied, as well as the touched position and area.

When there is a touch input with respect to the touch sensor, a corresponding signal (signals) are transmitted to a touch controller. The touch controller processes the signals and transmits corresponding data to the controller 180. Accordingly, the controller 180 may recognize which portion of the display unit 151 has been touched.

With reference to FIG. 1, a proximity sensor 141 may be disposed within or near the touch screen. The proximity sensor 141 is a sensor for detecting the presence or absence of an object relative to a certain detection surface or an object that exists nearby by using the force of electromagnetism or infrared rays without a physical contact. Thus, the proximity sensor 141 has a considerably longer life span compared with a contact type sensor, and it can be utilized for various purposes.

Examples of the proximity sensor 141 may include a transmission type photoelectric sensor, a direct reflection type photoelectric sensor, a mirror-reflection type photoelectric sensor, an RF oscillation type proximity sensor, a capacitance type proximity sensor, a magnetic proximity sensor, an infrared proximity sensor, and the like. When the touch screen is the capacitance type, proximity of the pointer is detected by a change in electric field according to the proximity of the and the touch screen (touch sensor) may be classified as a proximity sensor.

In the following description, for the sake of brevity, recognition of the pointer positioned to be close to the touch screen will be called a 'proximity touch', while recognition of actual contacting of the pointer on the touch screen will be called a 'contact touch'. When the pointer is in the state of the proximity touch, it means that the pointer is positioned to correspond vertically to the touch screen.

By employing the proximity sensor 141, a proximity touch and a proximity touch pattern (e.g., a proximity touch distance, a proximity touch speed, a proximity touch time, a proximity touch position, a proximity touch movement state, or the like) can be detected, and information corresponding to the detected proximity touch operation and the proximity touch pattern can be output to the touch screen.

The audio output module 152 may convert and output as sound audio data received from the wireless communication unit 110 or stored in the memory 160 in a call signal reception mode, a call mode, a record mode, a voice recognition mode, a broadcast reception mode, and the like. Also, the audio output module 152 may provide audible outputs related to a particular function performed by the mobile terminal 100 (e.g., a call signal reception sound, a message reception sound, etc.). The audio output module 152 may include a speaker, a buzzer, or other sound generating device.

The alarm unit 153 (or other type of user notification means) may provide outputs to inform about the occurrence of an event of the mobile terminal 100. Typical events may include call reception, message reception, key signal inputs, a touch input etc. In addition to audio or video outputs, the alarm unit 153 may provide outputs in a different manner to inform about the occurrence of an event. For example, the alarm unit 153 may provide an output in the form of vibrations (or other tactile or sensible outputs). When a call, a message, or some other incoming communication is received, the alarm unit 153 may provide tactile outputs (i.e., vibrations) to inform the user thereof. By providing such tactile outputs, the user can recognize the occurrence of various events even if his mobile phone is in the user's pocket. Outputs informing about the occurrence of an event may be also provided via the display unit 151 or the audio output module 152. The display unit 151 and the audio output module 152 may be classified as a part of the alarm unit 153.

The haptic module 154 generates various tactile effects the user may feel. A typical example of the tactile effects generated by the haptic module 154 is vibration. The strength and pattern of the haptic module 154 can be controlled. For example, different vibrations may be combined to be output or sequentially output.

Besides vibration, the haptic module 154 may generate various other tactile effects such as an effect by stimulation such as a pin arrangement vertically moving with respect to a contact skin, a spray force or suction force of air through a jet orifice or a suction opening, a contact on the skin, a contact of an electrode, electrostatic force, etc., an effect by reproducing the sense of cold and warmth using an element that can absorb or generate heat.

The haptic module 154 may be implemented to allow the user to feel a tactile effect through a muscle sensation such as fingers or arm of the user, as well as transferring the tactile effect through a direct contact. Two or more haptic modules 154 may be provided according to the configuration of the mobile terminal 100.

The memory 160 may store software programs used for the processing and controlling operations performed by the controller 180, or may temporarily store data (e.g., a phonebook, messages, still images, video, etc.) that are input or output. In addition, the memory 160 may store data regarding various patterns of vibrations and audio signals output when a touch is input to the touch screen.

The memory 160 may include at least one type of storage medium including a Flash memory, a hard disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, and an optical disk. Also, the mobile terminal 100 may be operated in relation to a web storage device that performs the storage function of the memory 160 over the Internet.

The interface unit 170 serves as an interface with every external device connected with the mobile terminal 100. For example, the external devices may transmit data to an external device, receives and transmits power to each element of the mobile terminal 100, or transmits internal data of the mobile terminal 100 to an external device. For example, the interface unit 170 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating the authority of using the mobile terminal 100 and may include a user identity module (UIM), a subscriber identity module (SIM) a universal subscriber identity module (USIM), and the like. In addition, the device having the identification module (referred to as 'identifying device', hereinafter) may take the form of a smart card. Accordingly, the identifying device may be connected with the terminal 100 via a port.

When the mobile terminal 100 is connected with an external cradle, the interface unit 170 may serve as a passage to allow power from the cradle to be supplied therethrough to the mobile terminal 100 or may serve as a passage to allow various command signals input by the user from the cradle to be transferred to the mobile terminal therethrough. Various command signals or power input from the cradle may operate as signals for recognizing that the mobile terminal is properly mounted on the cradle.

The controller 180 typically controls the general operations of the mobile terminal. For example, the controller 180 performs controlling and processing associated with voice calls, data communications, video calls, and the like. The controller 180 may include a multimedia module 181 for reproducing multimedia data. The multimedia module 181 may be configured within the controller 180 or may be configured to be separated from the controller 180. The controller 180 may perform a pattern recognition processing to recognize a handwriting input or a picture drawing input performed on the touch screen as characters or images, respectively.

The power supply unit 190 receives external power or internal power and supplies appropriate power required for operating respective elements and components under the control of the controller 180.

Various embodiments described herein may be implemented in a computer-readable or its similar medium using, for example, software, hardware, or any combination thereof.

For a hardware implementation, the embodiments described herein may be implemented by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electronic units designed to perform the functions described herein. Such embodiments may be implemented by the controller 180 itself.

For a software implementation, the embodiments such as procedures or functions described herein may be implemented by separate software modules. Each software module may perform one or more functions or operations described herein. Software codes can be implemented by a software application written in any suitable programming language. The software codes may be stored in the memory 160 and executed by the controller 180.

Figure 2A:
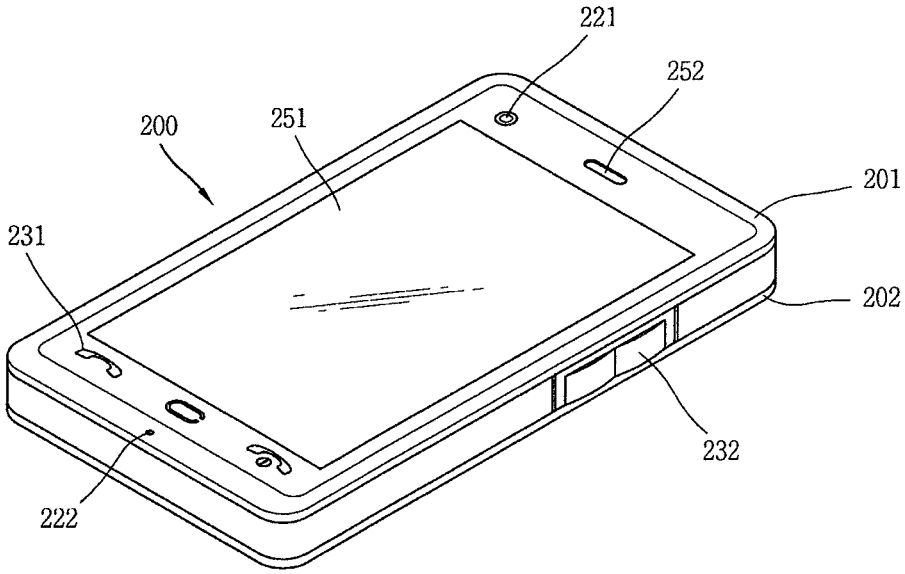
FIG. 2A is a rear perspective view of the mobile terminal according to an embodiment of the present invention.
Figure 2B:
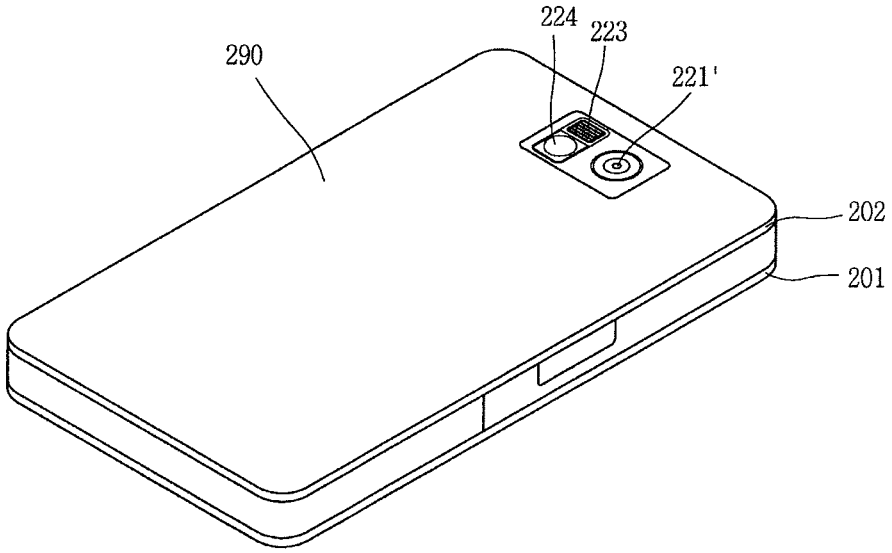
FIG. 2B is a front perspective view of the mobile terminal illustrated in FIG. 2A.

FIG. 2A is a rear perspective view of the mobile terminal according to an embodiment of the present invention, and FIG. 2B is a front perspective view of the mobile terminal illustrated in FIG. 2A.

The disclosed mobile terminal 200 has a bar type terminal body. However, without being limited thereto, the present invention can be also applicable to a slide type mobile terminal, a folder type mobile terminal, a swing type mobile terminal, a swivel type mobile terminal and the like, including two or more bodies.

The terminal body includes a case (or casing, housing, cover, etc.) constituting an external appearance of the terminal body. In the present embodiment, the case may be divided into a front case 201 and a rear case 202. Various electronic components are installed in the space between the front case 201 and the rear case 202. One or more intermediate cases may be additionally disposed between the front case 201 and the rear case 202.

The cases may be formed by injection-molding a synthetic resin or may be made of a metallic material such as stainless steel (STS) or titanium (Ti), etc. A display module 251, an audio output module 252, a camera 221, and a user input unit 230 (231, 232), a microphone 222, an interface 270, and the like, may be located on the terminal body, namely, mainly, on the front case 201.

The display module 251 occupies the most portion of the front surface of the front case 201. The audio output unit 251 and the camera 221 are disposed at a region adjacent to one of both end portions of the display module 251, and the user input unit 231 and the microphone 222 are disposed at a region adjacent to another of the both end portions. The user input unit 232, the interface 270, and the like, may be disposed at the sides of the front case 201 and the rear case 202.

The user input unit 230 is manipulated to receive commands for controlling the operation of the mobile terminal 200, and may include a plurality of manipulation units 231 and 232. The manipulation units 231 and 232 may be generally called a manipulating portion, and they can employ any method so long as they can be manipulated in a tactile manner by the user.

Content input by the first and second manipulation units 231 and 232 may be variably set. For example, the first manipulation unit 231 receives commands such as start, end, scroll, or the like, and the second manipulation unit 232 may receive commands such as adjustment of size of a sound output from the audio output unit 252 or conversion to a touch recognition mode of the display module 251. The display module 251 constitutes a touch screen along with the touch sensor 240 (See FIG. 3), and the touch screen may be an example of the user input unit 230.

FIG. 2B is a rear perspective view of the mobile terminal illustrated in FIG. 2A according to an embodiment of the present invention. With reference to FIG. 2B, a camera 221' may additionally be disposed on a rear surface of the terminal body, namely, on the rear case 202. The camera 221' may have an image capture direction which is substantially opposite to that of the camera 221 (See FIG. 2A), and may support a different number of pixels (i.e., have a different resolution) than the camera 221.

For example, camera 221 may operate with a relatively lower resolution to capture an image(s) of the user's face and immediately transmit such image(s) to another party in real-time during video call communication or the like. Meanwhile, the camera 221' may operate with a relatively higher resolution to capture images of general objects with high picture quality, which may not require immediate transmission in real time. The cameras 221 and 221' may be installed on the terminal such that they are rotated or popped up.

A flash 223 and a mirror 224 may be additionally disposed adjacent to the camera 221'. When an image of the subject is captured with the camera 221', the flash 223 illuminates the subject. The mirror 224 allows the user to see himself when he wants to capture his own image (i.e., self-image capturing) by using the camera 221'.

An audio output unit may be additionally disposed on the rear surface of the terminal body. The audio output unit may implement a stereoscopic function along with the audio output unit 252, and may be used for implementing a speaker phone mode during call communication (See FIG. 2A).

A power supply unit 290 for supplying power to the mobile terminal 200 may be mounted on the terminal body in order to supply power to the mobile terminal 200. The power supply unit 290 may be installed in the terminal body or may be directly detached from the outside of the terminal body.

A touch sensor 235 may be additionally mounted to detect a touch. The touch sensor 235 may be configured to be light-transmissive like the display module 251. When the display module 251 is configured to output visual information from both sides, the visual information can also be recognized through the touch sensor 235. The information output from both sides can be controlled by the touch sensor 235. Alternatively, a display may be additionally mounted on the touch sensor 235, so a touch screen may be disposed on the rear case 202.

The touch sensor 235 is operated in relation to the display module 251 of the front case 201. The touch sensor 235 may be disposed to be parallel to the rear side of the display module 251. The touch sensor 235 may have a size which is the same as or smaller than the display module 251.

An antenna for a call, or the like, may be mounted in the terminal main body, and in addition, a broadcast signal receiving antenna, a Bluetooth™ antenna, a satellite signal receiving antenna, an antenna for receiving data of wireless Internet, or the like, may be disposed in the terminal body.

The antennas may be combined to form an antenna device to integrally, collectively provide various communication services, and the mobile terminal according to an embodiment of the present invention implements a multi-antenna mechanism by the antenna device.

The antenna device may be configured to transmit and receive a radio signal corresponding to at least one of a personal communication system (PCS), an advanced wireless service (AWS), a digital communications network (DCN), and long terminal evolution (LTE). Hereinafter, a case in which the antenna device is configured to transmit and receive a broadband radio signal corresponding to LTE will now be described as an example.

Figure 3:
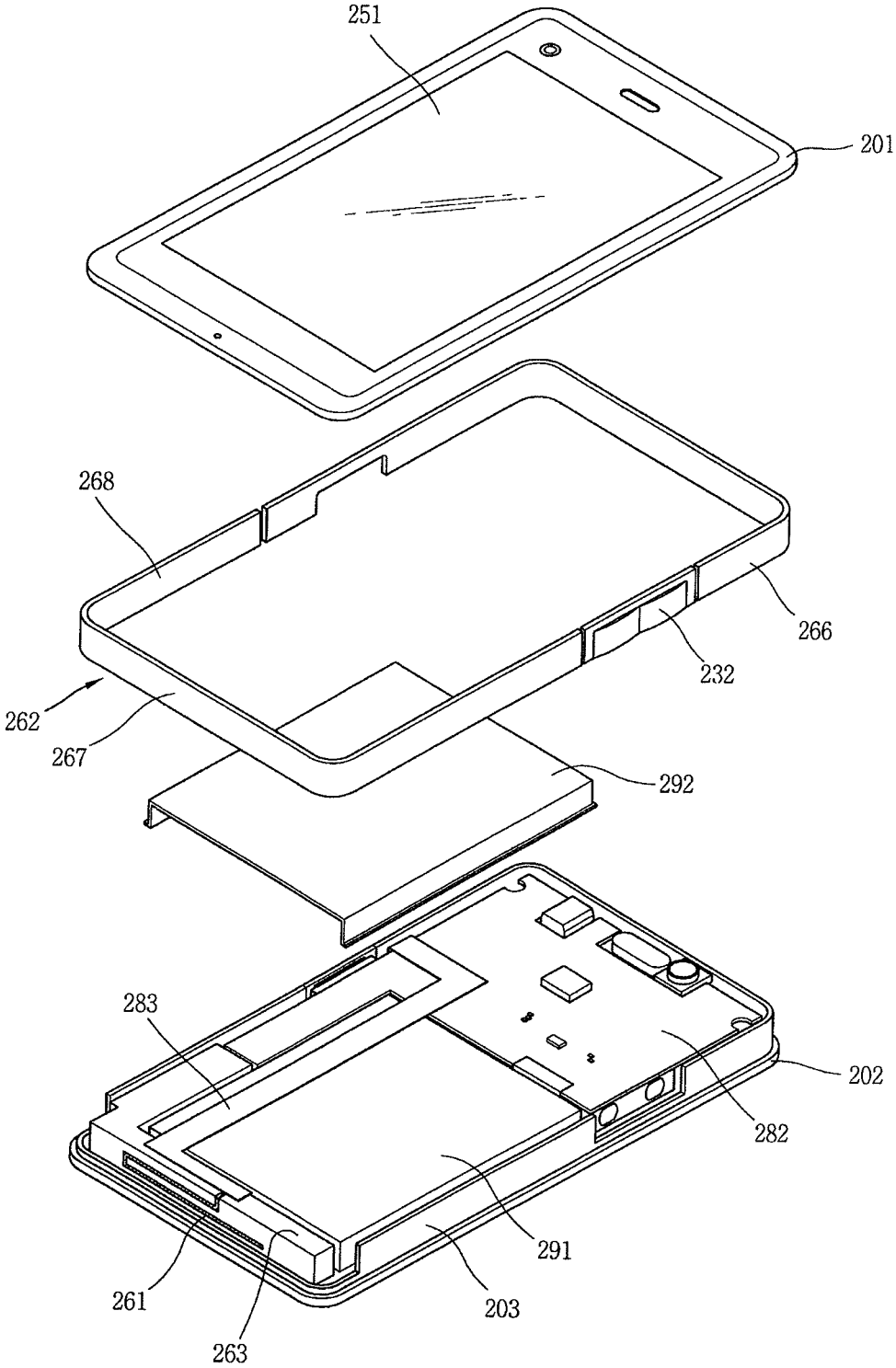
FIG. 3 is an exploded perspective view of the mobile terminal of FIG. 2B.
Figure 4A:
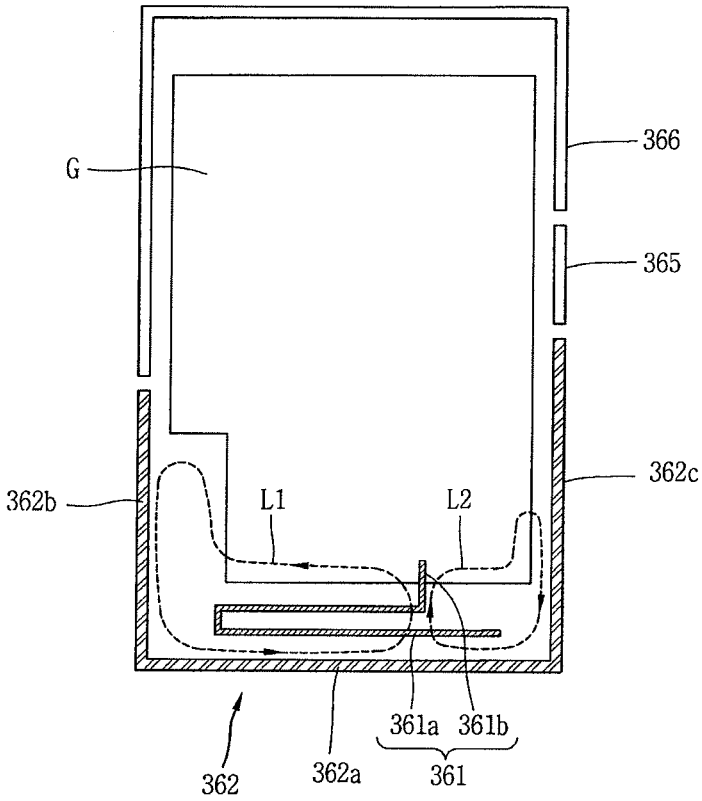
FIGS. 4A and 4B are a conceptual view and an equivalent circuit diagram of an antenna device of FIG. 3, respectively.
Figure 4B:
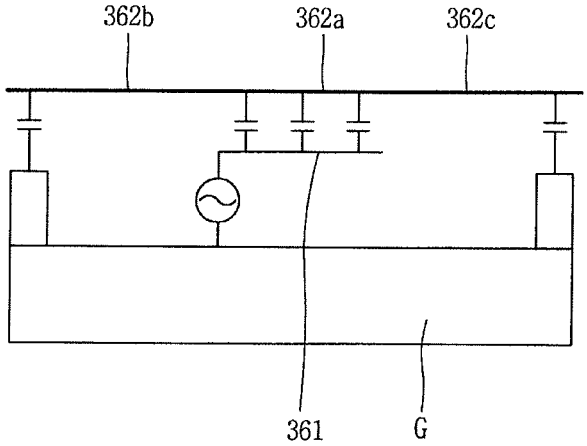
Figure 5:
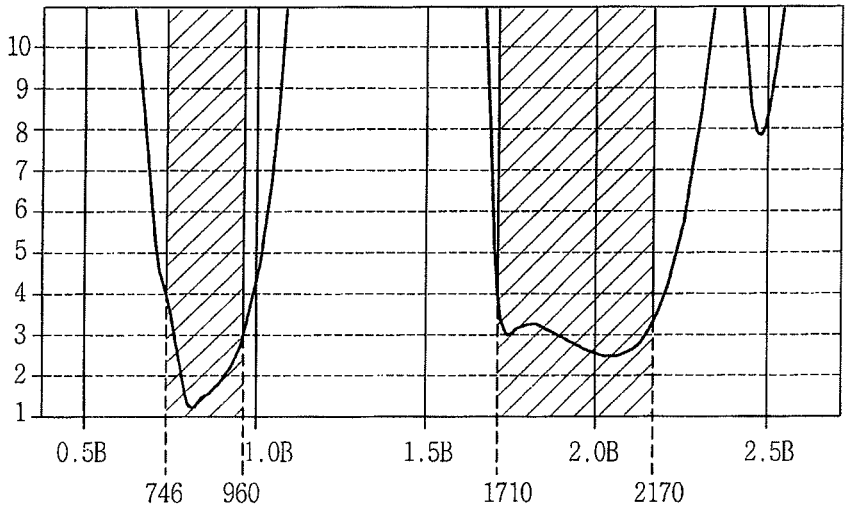
FIG. 5 is a graph of a voltage standing wave ratio (VSWR) of the mobile terminal of FIG. 3.

FIG. 3 is an exploded perspective view of the mobile terminal of FIG. 2B. FIGS. 4A and 4B are a conceptual view and an equivalent circuit diagram of an antenna device of FIG. 3, respectively. FIG. 5 is a graph of a voltage standing wave ratio (VSWR) of the mobile terminal of FIG. 3.

With reference to FIG. 3, the display module 251 is mounted on one surface of the front case 201 of the terminal main body. The display module 251 includes a window and a display element and may be configured to detect a touch input.

As illustrated, a circuit board 282 for controlling the display module 251 is installed in the terminal body. The circuit board 282 may be, for example, mounted on the front case 201 or the rear case 202, or may be mounted on an a separate internal structure. As illustrated, the circuit board 282 is disposed to cover an inner surface of the rear case 202. In the following description, the front case 201 or the rear case 202 are configured separately, but the present invention is not limited thereto and the front case 201 and the rear case 202 may be integrally formed.

Various electronic elements may be mounted on one surface of the circuit board 282, and a shield member for protecting the electronic elements may be mounted on one surface of the circuit board 282. The shield member may be electrically connected to the circuit board in order to extend a ground of the circuit board.

The circuit board 282 may be configured as an example of the controller 180 for operating various functions of the mobile terminal (See FIG. 1). A plurality of circuit boards 282 may be provided and combined to perform the function of the controller 180. Also, the circuit board 282 is electrically connected with the antenna device and configured to process a radio signal (or a radio electromagnetic wave) transmitted or received by the antenna device.

As illustrated, a battery 291 is disposed as an example of a power supply unit 290 within the terminal (See FIG. 2B). The battery 291 is accommodated in a mounting space of a mounting member 292 made of a metallic material. The mounting member 292 is electrically connected with the circuit board 282 so as to serve to extend the ground of the circuit board 282. In addition, ground layers of the mounting member 292, the shield member, and the circuit board 282 may be electrically connected to form a ground G of the terminal (See FIG. 4A). The ground G may be a portion of conductive loops L1 and L2 as shown in FIG. 4A for transmitting and receiving a radio signal in the antenna device.

With reference to FIG. 4A, the antenna device according to an embodiment of the present invention includes a first conductor 361 and a second conductor 362, and a combination thereof forms the plurality of conductive loops L1 and L2.

As illustrated, the first conductor 361 is installed in the terminal body and is connected with the ground G so as to be power-fed. The second conductor 362 is coupled with the first conductor 361 in order to transmit and receive radio signals of a plurality of mutually adjacent frequency bands. In detail, the first conductor 361 is a coupler 261, and the second conductor 362 serves to scatter electromagnetic waves in the air (See FIG. 3). For example, the first conductor 361 includes a conductive body 361*a* and a power feed arm 361*b*.

The conductive body 361*a* is coupled with the second conductor 362 and disposed on one surface of a carrier 263 (See FIG. 3). For example, one surface of the carrier 263 may face the side surface of a lower end (or a lower surface) of the terminal. With reference to FIG. 3, the carrier 263 is disposed to be adjacent to one end of the terminal body. In detail, the carrier 263 is disposed at a portion opposite to the circuit board 282 with the mounting member 292 or the battery 291 interposed therebetween.

The power feed arm 361*b* extends from the conductive body 361*a* and connected with the ground G so as to be power-fed. For example, one end of a flexible circuit board 283 is connected to the circuit board 282, the flexible circuit board 283 extends toward the carrier 263, and the other end of the flexible circuit board 283 is disposed at a lower portion of the carrier 263. The power feed arm 361*b* is in contact with a connection terminal (not shown) of the flexible circuit board 283, and accordingly, the power feed arm 361*b* is electrically connected with the ground G and is provided with power from an electric element (not shown) of the circuit board 282.

With reference to FIG. 4A, the second conductor 362 is formed to cover the entirety of the conductive body 361*a* in at least one direction. Accordingly, the first and second conductors 361 and 362 can be easily coupled.

The second conductor 362 faces the first conductor 361 so as to be coupled with the first conductor 361. For example, the second conductor 362 includes a first portion 362*a* and second portions 362*b* and 362*c*. The second portions 362*b* and 362*c* are formed on the edges of the second conductor 362, so the second portions 362*b* and 362*c* will be referred to as edge portions 362*b* and 362*c*, hereinafter. The first portion 362*a* is formed between the edges of the second conductor 362, so the first portion 362*a* will be referred to as a central portion 362*a* hereinafter. However, the present invention is not limited thereto. For example, the second portions 362*a* and 362*b* may be disposed at positions other than the edges of the second conductor 362.

As illustrated, the central portion 362*a* is separated by a pre-set distance from the first conductor 361 so as to be coupled with the first conductor 361. In order to facilitate coupling, the central portion 362*a* may be formed to be parallel with the conductive body 361*a* of the first conductor 361.

The edge portions 362*b* and 362*c* extend from the central portion 362*a* and are coupled at a plurality of points with the ground G so as to generate a plurality of conductive loops L1 and L2 continued from the ground G, the first conductor 361, and the second conductor 362 and back to the ground G.

In detail, the edge portions 362*b* and 362*c* extend from opposite side of the central portion 362*a*. Ends of the first and second edge portions 362*b* and 362*c* are separated to be adjacent to the ground G so as to be coupled with the ground G. Accordingly, the plurality of conductive loops form the first and second conductive loops L1 and L2.

In other words, the first and second conductive loops L1 and L2 share the first conductor 361 and branch off in the directions of the first and second edge portions 362*b* and 362*c*, and accordingly, the first and second edge portions 362*b* and 362*c* are able to transmit and receive radio signals of a plurality of frequency bands. Also, the first and second edge portions 362*b* and 362*c* have a similar length, not the same length, though, whereby the radio signals have mutually adjacent resonance frequencies, eventually implementing a transmission and reception of a broadband radio signals.

With reference to FIG. 4B, a capacitor is formed between the first and second conductors 361 and 362. Also, a capacitor is formed between both ends of the second conductor 362 and the ground G, whereby a plurality of antenna circuits including the plurality of conductive loops L1 and L2 illustrated in FIG. 4A are formed.

With reference to FIG. 4A, at least one of the first and second edge portions 362*b* and 362*c* is bent in a direction perpendicular to the direction of the central portion 362*a*. For example, both the first and second edge portions 362*b* and 362*c* are bent in a direction perpendicular to the central portion 362*a*.

The second conductor 362 may be exposed to form the frame of the terminal body. Also, the second conductor 362 is disposed at the lower end of the main body and extends to both side faces of the terminal body. Metal members 365 and 366 may be mounted on at least one of the side faces of the terminal body such that they are separated from the end portion of the second conductor 362. According to this structure, the second conductor 362 is able to operate as an antenna at an outer surface of the case of the terminal. An example in which the terminal employs the foregoing structure will now be described in detail with reference to FIG. 3.

With reference to FIG. 3, the coupler 261 is mounted in the carrier 263 installed in the terminal body, and the coupler 261 is connected with the circuit board 282 by way of the flexible circuit board 283 so as to be fed with power by the circuit board 282. In order for the coupler 261 to be connected with the circuit board 282 so as to be power-fed, a power feed terminal electrically connected to a connection terminal of the flexible circuit board may be formed at one end of the coupler 261.

The carrier 263 may be formed to be bent to face both sides of the case of the terminal which are perpendicular to each other. A portion facing a lower end of the terminal may form an antenna resonance space and a portion perpendicular thereto (or a vertical portion) may form an echo space of a speaker. To this end, a speaker may be mounted at the vertical portion.

The coupler 261 is coupled to the metal member 262 in a state of being separated by a pre-set distance from the first body 267 so as for the metal member 262 to transmit and receive a radio signal. Accordingly, the coupler 261 plays the role of the first conductor 361 of FIG. 4A. Through the coupling, a current path, starting from the ground of the circuit board 282 continued to the coupler 261 and to the metal member 262, is formed.

As illustrated, the metal member 262 is disposed at the side of the terminal body formed by the front case 201 and the rear case 202. The metal member 262 may be formed outside an intermediate case 203 between the cases 201 and 202 at the side of the terminal. A user input unit 232 and a metal decoration 266 are mounted on the side of the terminal such that they are connected to the metal member 262.

The metal member 262 plays the role of the second conductor 362 of FIG. 4A, and is mounted on a side wall of the intermediate case 203. Accordingly, the metal member 262 forms a portion of the edges of the terminal. The metal member 262 may extend to both sides based on a portion facing the coupler 261 so as to form a plurality of current paths.

For example, the metal member 262 includes first and second bodies 267 and 268, and an end portion of the second body 268 is disposed to be adjacent to the mounting member 292 or the circuit board 282. As illustrated, the second body 268 may be bent from both ends of the first body 267. However, the present invention is not limited thereto; the second body 268 may be bent from only one end of the first body 267.

Because the mounting member 292 is electrically connected with the ground of the circuit board 282, the end portion of the second body 268 is disposed to be adjacent to the ground of the circuit board 282. Accordingly, the current path is continued to the ground, forming a closed type path.

The user input unit 232 can be, for example, a side key, and can correspond to the metal member 365 of FIG. 4A. At least a portion of the user input unit 232 can be made of a conductive material so as to implement an integral design with the metal member 362, and can be formed to have a similar width to that of the metal member 262. A gap is formed between the metal member 362 and the user input unit 365 in order to separate the metal member 362 and the user input unit 365. In detail, a gap is formed between an end portion of the second body 268 and the user input unit 365 in order to separate the metal member 362 and the user input unit 365.

The metal decoration 266 corresponds to the metal member 366 of FIG. 4A, and a gap is formed between the metal member 362 and the metal decoration 366. Accordingly, the terminal can be implemented such that the metal material covers the entirety of the side surface of the terminal, while the antenna performance is maintained.

In this manner, because the antenna device is divided into two parts and one part is positioned at the existing carrier and the other is integrated with the case, whereby the volume of the LTE antenna can be reduced while implementing broadband.

With reference to FIG. 5, the mobile terminal exhibits such antenna characteristics that a resonance frequency has a broadband of 700 MHz to 960 Mhz. According to the graph, the mobile terminal of FIG. 3 is able to implement primary antenna characteristics of 746 MHz to 894 MHz and secondary MIMO antenna characteristics of 746 MHz to 756 MHz. In this manner, the antenna structure according to an embodiment of the present invention exhibits the broadband characteristics at the low frequency band of 1 GHz or lower.

Figure 6:
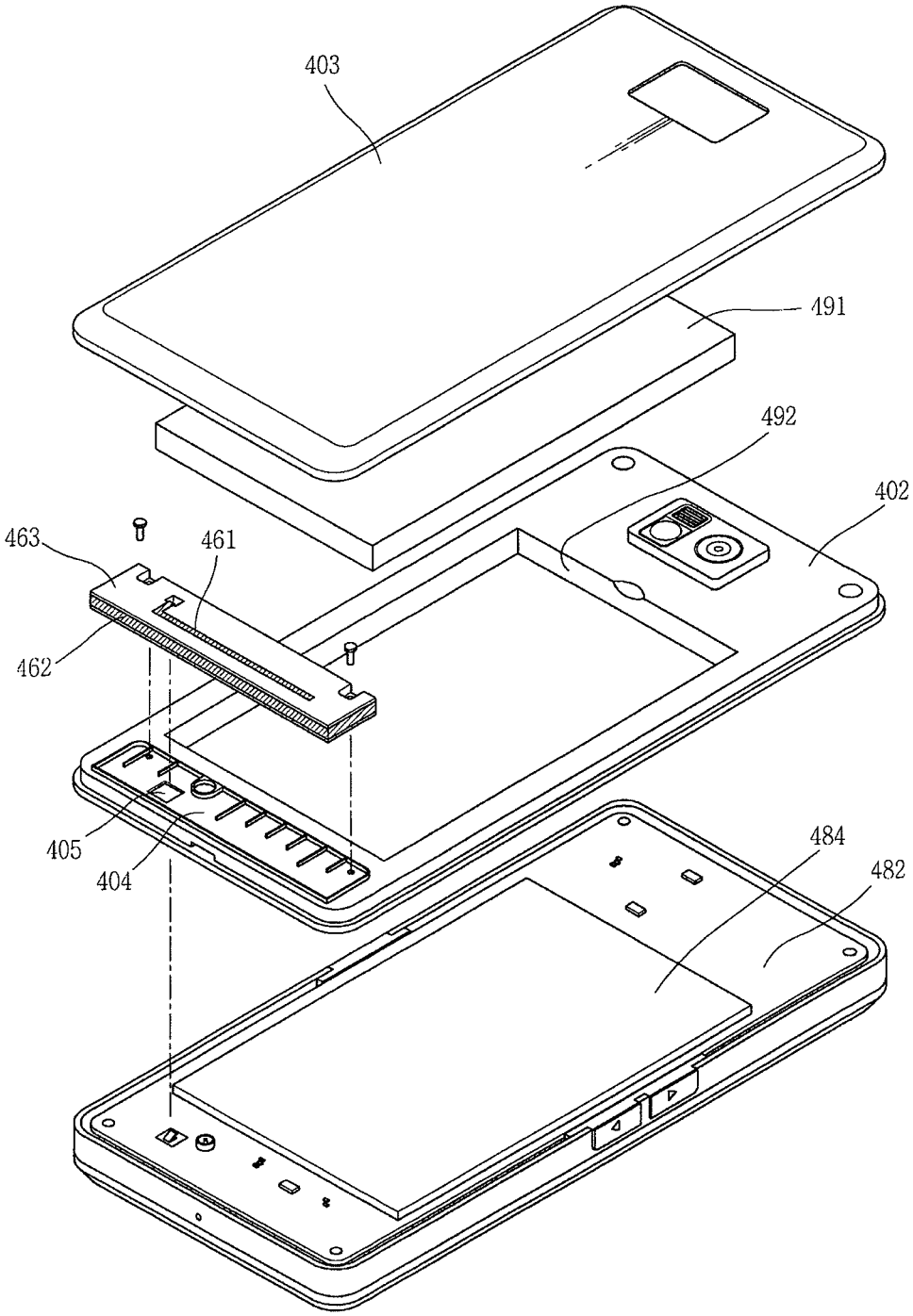
FIG. 6 is a rear exploded perspective view of another example of a mobile terminal according to an embodiment of the present invention.
Figure 7:
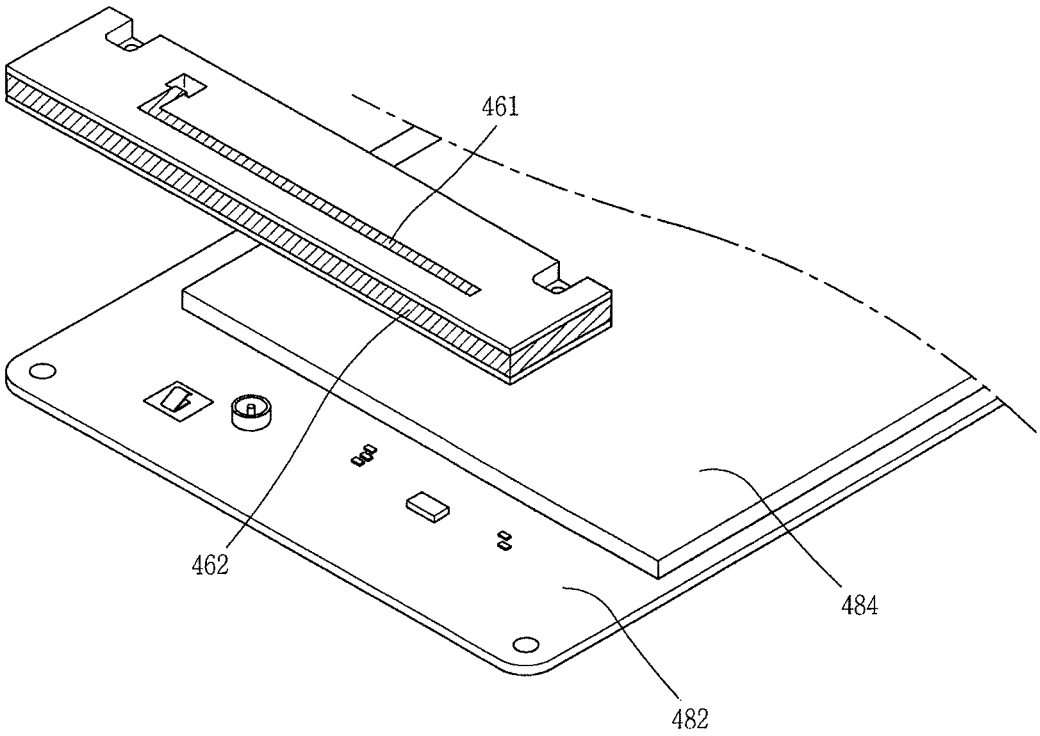
FIG. 7 is an enlarged view of a circuit board and the antenna device of FIG. 6.

FIG. 6 is a rear exploded perspective view of another example of a mobile terminal according to an embodiment of the present invention. FIG. 7 is an enlarged view of a circuit board and the antenna device of FIG. 6.

With reference to FIGS. 6 and 7, a circuit board 482 is installed in the terminal body, and various electronic elements are mounted on one surface of the circuit board 482. A shield member 484 for protecting the electronic elements may be mounted on the one surface of the circuit board 482. The shield member 484 may be, for example, made of a metal plate member.

An accommodation portion 492 in the form of a recess may be formed on a rear case 402 in order to accommodate a battery 491. The bottom of the accommodation portion 492 is hollowed, and the shield member 484 is exposed therefrom. According to this structure, the shield member 484 forms the bottom of the accommodation portion 492. The battery 491 and the accommodation portion 492 may be configured as an example of the power supply unit 290 (See FIG. 2B).

A battery cover 403 is mounted on the rear case 402 to cover the battery 491 and the accommodation portion 492. The battery cover 403 is provided as an example of a case forming an external appearance of the terminal body and is configured to cover the entirety of a rear surface of the terminal.

As illustrated, an antenna mounting portion 404 is formed to be adjacent to one side of the accommodation portion 492 at the rear case 402. The antenna mounting portion 404 is configured to allow a carrier 463 to be mounted thereon. Accordingly, the carrier 463 may be standardized to be applicable regardless of the types of terminals.

A first conductor 461 (or coupler) is disposed on one surface of the carrier 463. The first conductor 461 may be made of a conductive material and have a pre-set pattern. The first conductor 461 may be electrically connected with the circuit board 482 so as to be fed with power from the circuit board 482. To this end, a through hole 405 may be formed on the bottom of the antenna mounting portion 404 to allow the first conductor 461 (or coupler) and the circuit board 482 to be electrically connected therethrough.

As illustrated, the second conductor 462 is mounted on the carrier 463 such that it is separated from the first conductor 461, and the second conductor 462 is formed to face the case (e.g., the battery cover) of the terminal body. The second conductor 462 and the first conductor 461 are not directly connected but may be coupled in a facing state.

Both ends of the second conductor 462 are disposed to be adjacent to the shield member 484 with the rear case 402 interposed therebetween. Accordingly, the second conductor may be coupled with a ground, and the antenna structure corresponding to FIG. 4A may be implemented.

Figure 8:
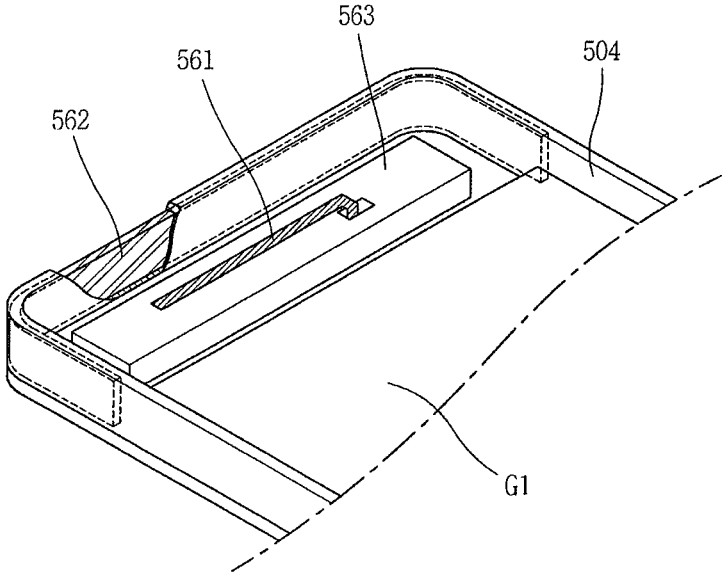
FIGS. 8 to 10 are conceptual views of modifications of the antenna device according to an embodiment of the present invention.
Figure 9:
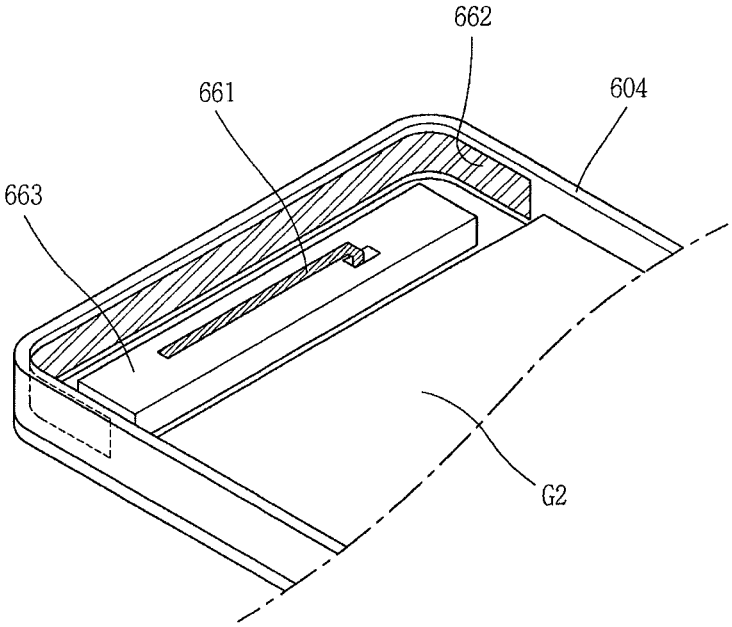
Figure 10:
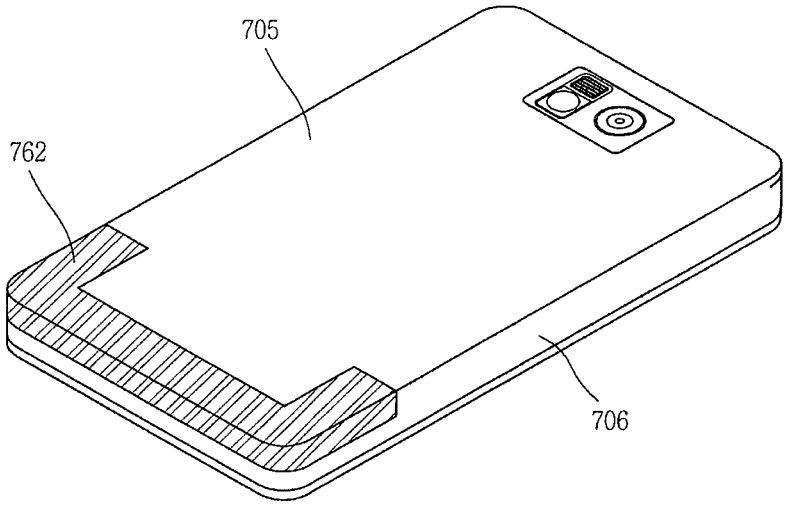

FIGS. 8 to 10 are conceptual views of modifications of the antenna device according to an embodiment of the present invention.

With reference to FIG. 8, a first conductor 561 is adjacent to one surface of a case 504 forming an external appearance of the terminal body, and a second conductor 562 is insertedly mounted in the case 504. In detail, the first conductor 561 is mounted on the carrier 563, and the carrier 563 is disposed to be adjacent to a side surface of the case 504.

The second conductor 562 is integrally installed in the case 504 through insert injection molding, or the like, and may be covered by a synthetic resin material so as not to be exposed. In addition, the second conductor 562 may extend along the side of the case 504 such that it is adjacent to a component G1 forming a ground and electrically coupled with the component G1.

With reference to FIG. 9, a second conductor 662 is patterned to be formed on one surface of a case 604. The case 604 is made of a synthetic resin material, and the second conductor 662 may be implemented through plating, or the like.

With reference to FIG. 10, the terminal body may have a front portion, a rear portion 705, and a side portion 706. A second conductor 762 is formed to be bent between at least one of the front portion and the rear portion 705 and the side portion 706 so as to be parallel to at least one of the front portion and rear portion 705 and the side portion 706.

Figure 11:
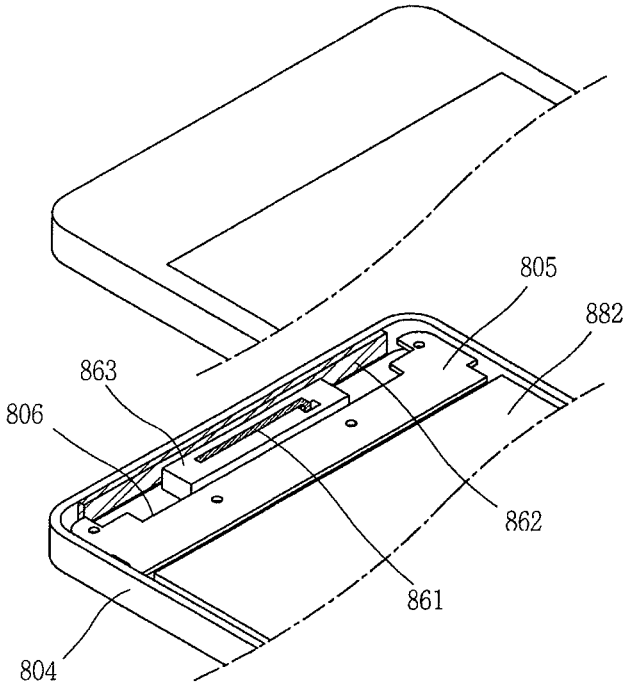
FIG. 11 is a conceptual view showing another example of a mobile terminal according to an embodiment of the present invention.
Figure 12:
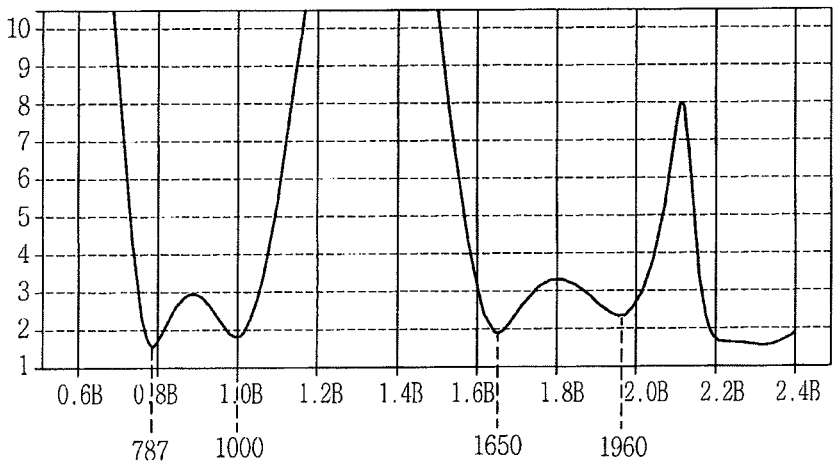
FIG. 12 is a graph of a voltage standing wave ratio (VSWR) of the mobile terminal of FIG. 11.

FIG. 11 is a conceptual view showing another example of a mobile terminal according to an embodiment of the present invention, and FIG. 12 is a graph of a voltage standing wave ratio (VSWR) of the mobile terminal of FIG. 11.

With reference to FIG. 11, a circuit board 882 is installed in the terminal body, and a metal plate member 805 is disposed between the circuit board 882 and a case 804. The metal plate member 805 is connected with the circuit board processing a radio signal so as to serve to extend the ground of the circuit board 882. Also, a speaker, a microphone, or the like, may be mounted on the metal plate member 805.

As illustrated, a recess 806 is formed toward the circuit board 882. A first conductor 861 is accommodated in the recess 806. For example, a carrier 863 is accommodated in the recess 806. A first conductor 861 is disposed on the carrier 863 and connected with the circuit board 882 so as to be power-fed Also, a second conductor 862 is disposed at an opening (or a portion adjacent to the opening) of the recess 806. The second conductor 862 may be disposed to be separated from the first conductor 861 but electrically coupled, and extends along one surface of the case 804 in both directions. Both ends of the second conductor 862 extend to positions beyond the recess 806, and accordingly, the both ends of the second conductor 862 are disposed at positions at which they are coupled with the metal plate member 805.

According to the structure, a plurality of conductive loops may be formed, and accordingly, the second conductor 862 may transmit and receive radio signals of multi-frequency band.

However, the present invention is not limited to the structure but may be variably modified. For example, the ground may be disposed one layer of the circuit board processing radio signals, a recess is formed may be formed on one end of the circuit board toward the other end of the circuit board, and the first conductor may be accommodated in the recess and the second conductor may be disposed in the opening of the recess.

With reference to FIG. 12, the mobile terminal of FIG. 11 exhibit broadband characteristics that a resonance frequency ranges from 787 MHz to 100 MHz. In this manner, the antenna structure according to an embodiment of the present invention implements broadband characteristics at a low frequency band of 1 GHz or lower, and also show broadband characteristics in any other bands than the LTE band.

Thus, in an embodiment of the present invention, because the antenna is physically divided into a plurality of parts, a portion of the antenna may constitute the case in a narrow space or may be mounted in the case.

In the antenna according to an embodiment of the present invention, because a plurality of conductive loops share a single coupler, the antenna can be formed within a smaller volume and transmit and receive radio signals of multi-frequency frequency. In addition, because the conductor radiating a radio signal is coupled to a coupler and a ground, multiple antennas sharing a portion of a conductive path can be implemented. Accordingly, the antenna according to an embodiment of the present invention can be implemented such that a change in the resonance frequency is reduced, and can have broadband antenna characteristics.

Also, because the antenna is divided into a conductor and a coupler, a portion of the antenna may constitute the case or allow for an antenna structure mounted in the case. Also, the mobile terminal can be configured to be thinner and transmit and receive radio signals at a broadband of low frequency. Also, according to the antenna structure, a specific absorption rate (SAR) can be reduced and impedance matching may be easily made.

As the embodiments may be implemented in several forms without departing from the characteristics thereof, it should also be understood that the above-described embodiments are not limited by any of the details of the foregoing description, unless otherwise specified, but rather should be construed broadly within its scope as defined in the appended claims. Therefore, various changes and modifications that fall within the scope of the claims, or equivalents of such scope are therefore intended to be embraced by the appended claims.

What is claimed is:

1. A mobile terminal, comprising:

a main body having a ground;

a first conductor installed in the main body and connected with the ground so as to be power-fed; and a second conductor facing the first conductor in order to be configured to transmit and receive radio signals of a plurality of mutually adjacent frequency bands to and from the first conductor, wherein the second conductor comprises:

a first portion spaced apart by a pre-set distance from the first conductor so as to be electromagnetically coupled with the first conductor; and second portions extending from both sides of the first portion and coupled at a plurality of locations with the ground in order to form a plurality of conductive loops extending from the ground and continued to the first conductor and the second conductor, wherein the second conductor is disposed in parallel with the first conductor and spaced part from the ground so as to be electromagnetically coupled with the first conductor, and wherein the first conductor comprises:

a conductive body parallel to the first portion of the second conductor so as to be electromagnetically coupled with the second conductor; and a power feed arm extending from the conductive body and directly connected to the ground, and wherein the conductive body and the power feed arm are integrally formed.

2. The mobile terminal of claim 1, further comprising a carrier mounted to be adjacent to one end of the main body, wherein the conductive body is on one surface of the carrier.

3. The mobile terminal of claim 2, wherein the second conductor is mounted on one surface of the carrier, and formed to face the main body.

4. The mobile terminal of claim 1, wherein the second conductor covers the entire conductive body in at least one direction.

5. The mobile terminal of claim 1, wherein the second portions include first and second edge portions formed at edges of the second conductor.

6. The mobile terminal of claim 5, wherein the plurality of conductive loops include first and second conductive loops, and the first and second conductive loops share the first conductor and branch off from the second conductor first portion to the first and second edge portions of the second conductor.

7. The mobile terminal of claim 5, wherein end portions of the first and second edge portions are electrically coupled with the ground.

8. The mobile terminal of claim 5, wherein the first and second edge portions are configured to transmit and receive radio signals of a plurality of mutually adjacent frequency bands.

9. The mobile terminal of claim 5, wherein at least one of the first and second edge portions of the second conductor is perpendicular to the first portion.

10. The mobile terminal of claim 1, wherein the second conductor is exposed from a side portion of the main body to constitute a frame of the main body.

11. The mobile terminal of claim 10, wherein the second conductor is disposed at a lower end of the main body and extends to a lower end of the side portion of the main body, and a metal member is mounted on at least one of the both sides of the main body such that the metal member is separated from the end portion of the second conductor.

12. The mobile terminal of claim 1, wherein the first conductor is adjacent to one surface of the main body, and the second conductor is formed on one surface of the main body or mounted in the main body.

13. The mobile terminal of claim 1, wherein the ground is a metal plate member connected with a circuit board which processes the radio signals, wherein a recess is formed at one end of the metal plate member, wherein the first conductor is accommodated in the recess, and wherein the second conductor is in an opening of the recess.

14. The mobile terminal of claim 1, wherein the main body comprises a front portion, a rear portion, and a side portion, and the second conductor extends between at least one of the front portion, the rear portion, and the side portion such that the second conductor is parallel to the at least one of the front portion, the rear portion, and the side portion.

15. The mobile terminal of claim 1, wherein a transmission frequency of the radio signal includes a frequency corresponding to LTE (Long Term Evolution).

* * * * *